US008091651B2

(12) United States Patent
Kuhnle et al.

(10) Patent No.: US 8,091,651 B2
(45) Date of Patent: Jan. 10, 2012

(54) HAND-HELD POWER TOOL

(75) Inventors: Axel Kuhnle, Freiberg A. N. (DE); Karl Frauhammer, Leinfelden-Echterdingen (DE); Willy Braun, Neustetten (DE)

(73) Assignee: Robert Bosch GmbH, Stuttgard (DE)

( * ) Notice: Subject to any disclaimer, the term of this patent is extended or adjusted under 35 U.S.C. 154(b) by 364 days.

(21) Appl. No.: 12/298,414

(22) PCT Filed: May 4, 2007

(86) PCT No.: PCT/EP2007/054362

§ 371 (c)(1),
(2), (4) Date: Oct. 24, 2008

(87) PCT Pub. No.: WO2008/000543

PCT Pub. Date: Jan. 3, 2008

(65) Prior Publication Data

US 2009/0120658 A1 May 14, 2009

(30) Foreign Application Priority Data

Jun. 28, 2006 (DE) ..... 10 2006 029 630

(51) Int. Cl.
*B25D 17/04* (2006.01)
*B25D 17/24* (2006.01)

(52) U.S. Cl. ..... 173/162.2; 173/48; 173/162.1

(58) Field of Classification Search ..... 173/162.2, 173/162.1, 104, 90, 217
See application file for complete search history.

(56) References Cited

U.S. PATENT DOCUMENTS 3,322,211 A * 5/1967 Alabuzhev et al. ..... 173/162.2
3,919,573 A 11/1975 Schmuck
4,282,938 A * 8/1981 Minamidate ..... 173/162.2
4,478,293 A * 10/1984 Weilenmann et al. ..... 173/162.2
4,749,049 A * 6/1988 Greppmair ..... 173/162.2
4,800,965 A * 1/1989 Keller ..... 173/162.2
5,025,870 A * 6/1991 Gantner ..... 173/162.2
5,522,466 A * 6/1996 Harada et al. ..... 173/162.2
5,697,456 A 12/1997 Radle et al.
6,076,616 A * 6/2000 Kramp et al. ..... 173/162.2
6,148,930 A * 11/2000 Berger et al. ..... 173/162.2
6,957,706 B2 10/2005 Burger et al.
6,962,211 B2 * 11/2005 Daubner et al. ..... 173/162.2
7,100,706 B2 * 9/2006 Meixner et al. ..... 173/162.2
7,721,390 B2 * 5/2010 Pfeiffer et al. ..... 16/426
2003/0037937 A1 * 2/2003 Frauhammer et al. ..... 173/48
2003/0206779 A1 11/2003 Kopras et al.
2004/0231867 A1 11/2004 Becht et al.

(Continued)

FOREIGN PATENT DOCUMENTS

AU 2004231220 6/2005

(Continued)

*Primary Examiner* — Lindsay Low

(74) *Attorney, Agent, or Firm* — Michael J. Striker

(57) ABSTRACT

A hand-held power tool includes a main element with a normal axis which extends perpendicularly to a tool axis and through a center of gravity. A handle is supported in the plane of motion defined by the tool axis and the normal axis such that it is movable relative to the main element. A spring unit connects the handle with the main element, and has a spring element to define a trajectory of at least one portion of the handle in the plane of motion under the influence of a load force triggered when the handle is moved out of a neutral position and approaches the stationary main element. A rotary element defines a joint-free rotation axis, about which the handle rotates in the plane of motion when a motion takes place relative to the main element.

8 Claims, 9 Drawing Sheets

U.S. PATENT DOCUMENTS

| | | | | |
|---|---|---|---|---|
| 2006/0219418 | A1* | 10/2006 | Arakawa et al. | 173/162.2 |
| 2007/0034397 | A1* | 2/2007 | Fischer et al. | 173/162.2 |
| 2008/0017396 | A1* | 1/2008 | Kristen et al. | 173/162.2 |
| 2008/0047724 | A1* | 2/2008 | Fischer et al. | 173/162.2 |
| 2009/0218114 | A1* | 9/2009 | Ohlendorf et al. | 173/211 |
| 2010/0012339 | A1* | 1/2010 | Hahn et al. | 173/162.2 |

FOREIGN PATENT DOCUMENTS

| | | |
|---|---|---|
| CH | 516 377 | 12/1971 |
| DE | 1 752 856 | 4/1971 |
| DE | 41 24 574 | 1/1993 |
| DE | 197 35 506 | 11/1998 |
| EP | 1 125 698 | 8/2001 |
| EP | 1 491 296 | 12/2004 |
| EP | 1 510 298 | 3/2005 |
| EP | 1 529 603 | 5/2005 |
| EP | 1 533 084 | 5/2005 |
| FR | 643 674 | 5/1964 |
| GB | 112 786 | 1/1918 |
| GB | 1 344 135 | 1/1974 |

* cited by examiner

HAND-HELD POWER TOOL

CROSS-REFERENCE TO RELATED APPLICATION

The invention described and claimed hereinbelow is also described in German Patent Application DE 10 2006 029 630.3 filed on Jun. 28, 2006. This German Patent Application, whose subject matter is incorporated here by reference, provides the basis for a claim of priority of invention under 35 U.S.C. 119(a)-(d).

BACKGROUND OF THE INVENTION

The present invention relates to a hand-held power tool, in particular a rotary hammer and/or chisel hammer, with a main element and a handle.

A hand-held power tool with a main element and a handle has been described. To dampen a transmission of vibrations of the main element to the handle, the handle is supported such that it is movable relative to the main element, and it is connected with the main element via a spring element.

SUMMARY OF THE INVENTION

The present invention is directed to a hand-held power tool, in particular a rotary hammer and/or chisel hammer, with a main element—which includes a tool axis, a center of gravity, and a normal axis, which extends perpendicularly to the tool axis and through the center of gravity, the tool axis and the normal axis defining a plane of motion—and which includes a handle, which is supported in the plane of motion such that it is movable relative to the main element, and including a spring unit having at least one spring element and which connects the handle with the main element.

It is provided that the spring unit is provided to at least substantially define a trajectory of at least one portion of the handle in the plane of motion under the influence of a load force, which is triggered when the handle is moved out of a neutral position and approaches the stationary main element. As a result, a particularly great stability of the handle and an advantageous tactile feeling of security in the handling of the hand-held power tool may be attained without negatively affecting the mobility of the handle in the plane of motion.

The hand-held power tool is preferably provided with guide means, which are provided to prevent the handle from becoming displaced perpendicularly to the plane of motion. The handle may be guided using these guide means as they move in the plane of motion. In this context, a motion of a rigid body "in" the plane of motion refers, in particular, to a planar motion of this rigid body at least substantially parallel to the plane of motion. In this context, a motion of the rigid body "at least substantially parallel" to the plane of motion refers, in particular, to a motion with which a motion component that is perpendicular to the plane of motion comprises less than 15%, preferably less than 10%, and particularly preferably less than 5% of the total motion of the rigid body. The trajectory is preferably a curved path that includes an axial component along the tool axis and a normal component along the normal axis. The trajectory of the portion of the handle is "specified", in particular, "by the spring unit" when the portion of the handle is guided—while the handle is undergoing its approaching motion—via the exclusive influence of the spring unit in this trajectory. When the handle is making its approaching motion, the portion of the handle may be guided along a path of motion that may deviate from the trajectory due to the influence of parts other than the spring unit. The spring unit defines the trajectory "at least substantially" in particular when the path of motion deviates by a small amount, which is 15% at most, advantageously 10% at most, and, particularly preferably, 5% at most of the entire length of the trajectory. In other words: The path of motion is located within a tolerance range around the trajectory, which extends coaxially with the trajectory and transversely to the direction of motion by the small amount of deviation. A "load force" refers, in particular, to an external force that is applied to the hand-held power tool. The load force may be applied to the handle by an operator via its actuation in a working direction. In this context, a "working direction" refers, in particular, to a preferred direction, in which the hand-held power tool is pressed against a tool or a workpiece. The working direction preferably corresponds at least substantially to the tool axis of the main element. For example, the working direction forms an angle of less than 15°, and, in particular, of less than 10°, with the tool axis. The load force may also be a force that is applied to the main element by a workpiece to be worked. The term "stationary" main element is intended to clarify that the main element is selected to be a stationary reference system, which is used to describe relative motions of the handle and the main element. The term "stationary position" of the handle or the main element may be understood to be a position of the handle and/or the main element relative to the main element and/or the handle in which no external forces are applied to the handle and/or the main element. A "tool axis" refers, in particular, to an axis that is defined by a tool fitting of the hand-held power tool, along which a tool is guided into the tool fitting. The "main element" may include everything that is fastened to the hand-held power tool except for the handle. The handle is preferably designed as the main handle of the hand-held power tool. In addition to the main handle, the hand-held power tool may also include an auxiliary handle. A "portion" of the handle refers, in particular, to a contiguous subregion of the handle that preferably forms at least 10% of the total volume of the handle.

When the handle is regarded as a stationary reference system, a high damping effect may be attained when a significant portion of the main element is guided in a trajectory with a motion component along the normal axis when the main element is moved—due to the load force that is applied—out of a neutral position and approaches the stationary handle. A portion such as this is preferably 10 percent by weight, and, in particular, at least 35 percent by weight of the main element, it being possible for a portion of more than 50 percent by weight of the main element to result in a particularly good vibration damping of the handle.

It is also provided that the spring unit includes support means for supporting the spring element, which—in interaction with the spring element—define the trajectory. It is therefore possible to specify the trajectory, using simple design means, by selecting the design parameters of the hand-held power tool, in particular via the shaping of the support means, their position, etc.

A high damping effect may be attained when the handle includes a handle body, and the hand-held power tool includes a rotary element that connects the handle body and the main element, the rotary element—in interaction with the spring unit—defining a joint-free rotation axis, about which the handle rotates in the plane of motion when a motion is made relative to the main element. The rotation axis is preferably formed by the instantaneous center of the handle. The instantaneous center is known from the theory of the rigid body. It is a point about which a planar motion of the rigid body may be instantaneously identified as pure rotation, i.e., it is a point that is instantaneously at rest. The instantaneous center of the handle may shift in three dimensions during the motion of the handle relative to the main element itself.

In a preferred embodiment of the present invention, it is provided that the spring element is designed as a leaf spring. By designing the spring element of the spring unit as a leaf spring, it is possible to attain an advantageous stabilization of the handle perpendicularly to the plane of motion, and to attain high mobility of the handle in the plane of motion using simple design means and in a cost-effective manner, by designing the leaf spring with a specific profile. A main deformation direction of the leaf spring preferably corresponds to an axis in the plane of motion, in particular the tool axis.

It is also provided that the handle is held in the neutral position by the spring element. As a result, it is possible to eliminate further components, installation space, assembly expense, and costs, since an additional retaining element which would be used to maintain the neutral position may be eliminated.

In a further embodiment of the present invention, it is provided that the spring unit includes support means for supporting the spring element, and the spring element rolls on the support means when the handle moves relative to the main element. Particularly high stability in the support of the spring element may be attained as a result. The trajectory may be defined easily and in a flexible manner by selecting the position of the support means relative to the handle and its shape, in particular its radius.

When the hand-held power tool includes a first housing element and a second housing element, a fastening element for fastening the first housing element to the second housing element, and support means for supporting the spring element, which is fixed in position on the fastening element, it is possible to advantageously reduce installation space and assembly expense. The first and second housing elements are preferably designed as an assembly shell and/or a cover shell, in particular of the main element. To further reduce the manufacturing expense, the support means may be designed as a single piece with the fastening element.

A particularly stable support of the spring element may be attained using simple design means and in a compact manner when the spring element includes a subregion that encloses the fastening element at least substantially.

The assembly expense may be further reduced when the hand-held power tool includes clamping means for clamping the spring element. A particularly stable and compact clamp connection may be attained when the spring element includes a subregion that encloses the clamping means.

It is furthermore provided that the handle includes a handle body, and the hand-held power tool includes a housing element, a bellows unit, which connects the main element with the handle body, and a fixing element, which is provided to fix, at the least, the bellows unit and the spring element on the housing element. The number of fastening elements may be advantageously reduced as a result.

The present invention is also directed to a hand-held power tool, in particular a rotary hammer and/or chisel hammer, with a main element, which includes a housing element, and a handle, which includes a handle body. It is provided that the hand-held power tool includes a fastening module, which may be removed from the handle body and inserted in the housing element, the fastening module forming a fastening interface for fastening the handle body to the main element. An advantageous module design of the hand-held power tool and simple assembly may be attained as a result. The housing element is preferably designed as an assembly shell of the main element. The assembly expense may be further reduced when the fastening module is provided to establish the form-fit connection with the main element.

When the handle body is connected with the main element via a vibration-decoupling unit that is installed on the fastening module, it is possible to eliminate installation space and fastening elements. Assembly expense may be minimized when the vibration-decoupling unit is clamped together with the fastening module.

It is also provided that the fastening module includes a bellows unit, which connects the handle body and the main element. As a result, it possible to attain—in addition to the fastening function of the fastening module—an advantageous safeguard against pinch injuries and penetration by dirt particles.

Further advantages result from the description of the drawing, below. Exemplary embodiments of the present invention are shown in the drawing. The drawing, the description, and the claims contain numerous features in combination. One skilled in the art will also advantageously consider the features individually and combine them to form further reasonable combinations.

DESCRIPTION OF THE PREFERRED EMBODIMENTS

Figure 1:
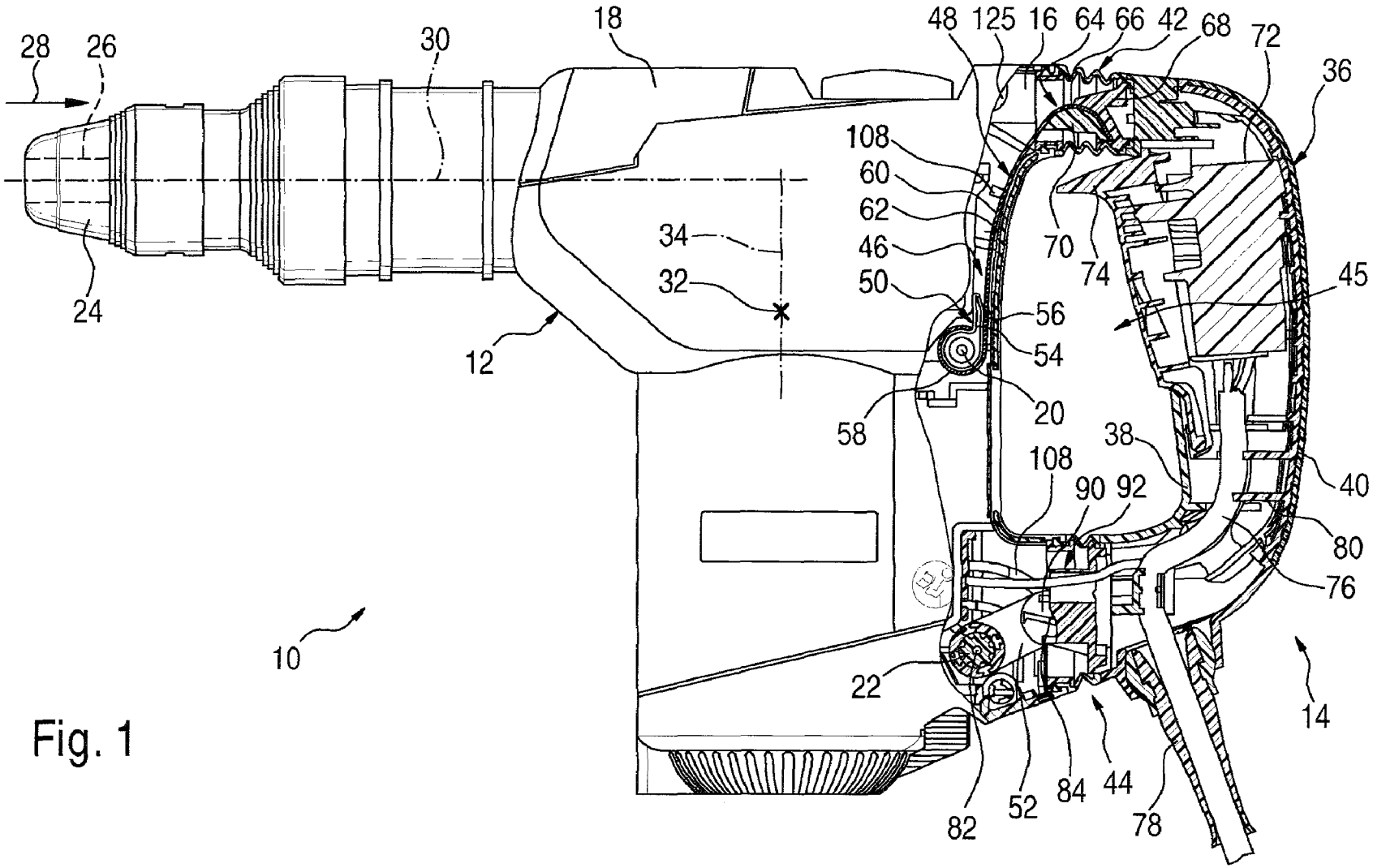
FIG. 1 shows a rotary hammer and/or chisel hammer with a main element and a handle, which is connected with the main element via a leaf spring.

FIG. 1 shows a hand-held power tool 10, which is designed as a rotary hammer and/or a chisel hammer. It includes a main element 12 and a handle 14. Main element 12 includes a housing having an assembly shell—which is designed as a first housing element 16, in which, when assembled, inner components of hand-held power tool 10 are fixed in position—and having a cover shell, which is designed as a second housing element 18. When hand-held power tool 10 is in the assembled state, first housing element 16 is screwed together with second housing element 18. For this purpose, first housing element 16 includes two fastening elements 20, 22, which are designed as screw receptacles, each of which—in the installed state—accommodates a screw. Hand-held power tool 10 also includes a tool fitting 24, in which a tool, e.g., a drill or a chisel, may be inserted. Tool fitting 24 includes a cylindrical cavity 26, in which the tool may be inserted in an insertion direction 28 along an axis, which is referred to as tool axis 30 in this description. A drive unit, which is designed as an electric motor and is not depicted in the figure, is also supported in main element 12. Center of gravity 32 of main element 12 is depicted schematically with a cross. A normal axis 34 extends through center of gravity 32, perpendicularly to tool axis 30.

Handle 14 includes a handle body 36 with a housing element 38, which is designed as a handle pot, and in which inner components of handle 14 are installed. Handle 14 also includes a handle cover 40 (see also FIG. 9). Handle 14 is designed as a bow-shaped assembly, in which the ends of the bow are oriented along tool axis 30. Handle body 36 is connected with housing elements 16, 18 of main element 12 via two bellows units 42, 44. Via bellows units 42, 44, it is possible to attain an advantageous seal and protection for the operator against pinch injuries. In addition, handle 14 is supported such that it is movable relative to main element 12, and it is connected with main element 12 via a vibration-decoupling unit 45. Vibration-decoupling unit 45 is provided to decouple a transfer of vibrations of main element 12 to handle 14. For this purpose, vibration-decoupling unit 45 includes a spring unit 46, which includes a spring element 48 designed as a leaf spring, and support means 50 for supporting spring element 48 in main element 12. Vibration-decoupling unit 45 also includes a rotary element 52, which is designed as a lever element. Hand-held power tool 10 depicted in FIG. 1 is located in a neutral position, in which no external forces are applied to main element 12 or handle 14.

Support means 50 are designed as a single piece with fastening element 20. Support means 50 include an annular subregion, which forms fastening element 20 designed as a screw receptacle. A projection 54 is integrally formed with this subregion, which extends along normal axis 34 in the direction toward tool axis 30 and forms a mating surface 56 for placement of spring element 48 whose function is described below. Spring element 48 includes a first subregion 58, which is designed as an eyelet and encloses fastening element 20 and/or is rolled around fastening element 20. Starting from subregion 58 outward, spring element 48 continues in the direction toward tool axis 30 and includes a center subregion 60, which—in the neutral position of hand-held power tool 10 shown in FIG. 1—bears against a mating surface 62 formed on a wall of housing element 16 of main element 12. In a variant of the embodiment, it is feasible to use a foamed material as the layer between subregion 60 and mating surface 62. Spring element 48 is also supported in a connection region 64 of hand-held power tool 10, connecting region 64 being enclosed by bellows unit 42. By locating the bearing point of spring element 48 in connection region 64, it is possible to attain a particularly compact design of handle 14, since it is possible to eliminate bearing space in handle body 36. An end 66 of spring element 48 is supported in connection region 64, end 66 being attached to handle body 36 via a fixing element 68. To attach end 66 to fixing element 68, hand-held power tool 10 is provided with clamping means 70. End 66 is clamped between clamping means 70 and fixing element 68. Clamping means 70 are screwed together with handle body 36. End 66 of spring element 48 is clamped between clamping means 70 and fixing element 68 in a non-positive and form-fit manner. The configuration of clamping means 70, end 66, and fixing element 68, and the attachment of this configuration to handle body 36 are shown in greater detail in FIG. 9. End 66 is designed as a parabolic section that encloses clamping means 70.

In addition, a switch 72 is installed in housing element 38, which is designed as a handle pot. Switch 72 may be actuated by an operator using a press button 74, which is swivelably supported in the handle pot, in order to start and stop an operation of hand-held power tool 10. An electrical cable connection 76 is also shown, which extends from switch 72 to a cable guide 78, which has been inserted in housing element 38. Inside handle body 36, cable connection 76 is clamped between segments 80.

Rotary element 52 is supported such that it may rotate relative to main element 12 and handle body 36. Rotary element 52 is hingedly supported on one side around a rotation point 82, which is fixed with main element 12 and corresponds to the center point of fastening element 22. On the other side, rotary element 52 is also hingedly supported around a rotation point 84, which is fixed with handle body 36. In addition, it is designed as a lever element that includes two lever arms 86, 88 (see FIG. 9). Lever arms 86, 88 are hingedly supported in a lever receptacle 90, which is fixedly connected with handle body 36. Lever receptacle 90 is located in a connection region 92, which is enclosed by bellows unit 44. Lever arms 86, 88 are also hingedly supported on fastening element 22, which is designed as a screw receptacle. Lever arms 86, 88 are described in greater detail with reference to FIG. 9.

Figure 2:
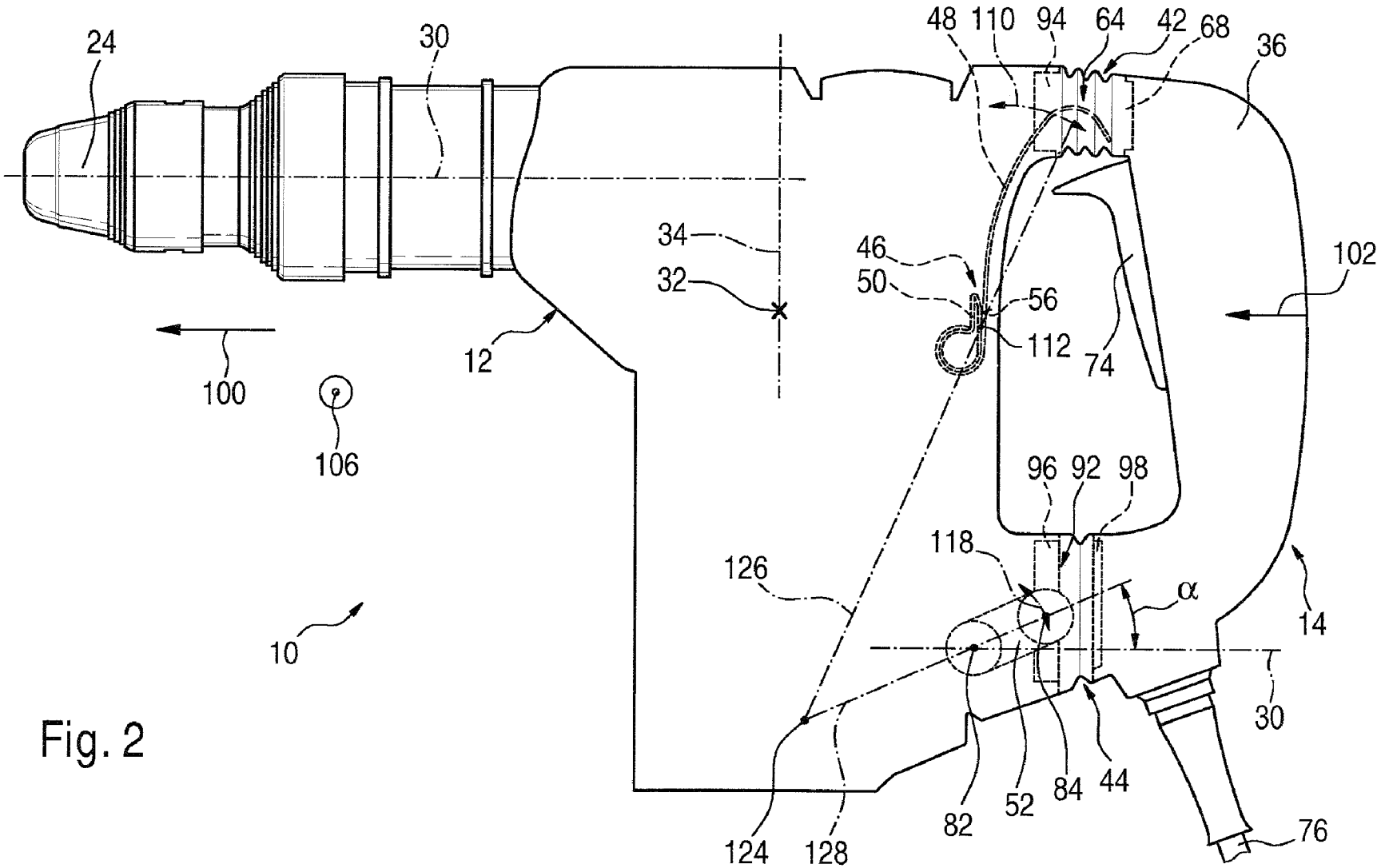
FIG. 2 is a simplified view of the rotary hammer and/or chisel hammer in a neutral position.

FIG. 2 shows hand-held power tool 10 in a view—which has been simplified, for clarity—in the neutral position shown in FIG. 1. In addition to the components described with reference to FIG. 1, further fixing elements 94, 96, 98 for fixing the bellows units 42, 44 are depicted schematically. Fixing elements 94, 96, which are fixedly connected with main element 12, are used to fix bellows unit 42 and/or 44 to main element 12. Fixing element 98, which is fixedly connected with handle body 36, is used to fix bellows unit 44 on handle body 36. Handle 14 is held in the neutral position by spring element 48. In its neutral position, handle body 36 is acted upon with a spring force of spring element 48, which holds handle body 36 in its neutral position. If handle 14 is located outside of its neutral position, spring element 48 tends to return handle 14 to its neutral position. In order to be able to initiate a motion of handle body 36, which is in the neutral position, a load force that is greater than the spring force must be exerted against the spring force.

It is assumed that an operator actuates handle body 14 and, in order to machine a work piece (not depicted), he presses hand-held power tool 10 against the work piece in a working direction 100. The operator exerts a load force 102 in working direction 100 on handle body 36, which, if the force is strong enough, causes handle 14 to move out of the neutral position shown and approach main element 12. Rotary element 52 is used as guide means to guide this motion in a plane of motion, which passes through tool axis 30 and normal axis 34. Rotary element 52 prevents handle 14 from becoming displaced perpendicularly to the plane of motion. Spring element 48, which is designed as a leaf spring, provides an additional stabilizing function perpendicularly to the plane of motion. Spring element 48 includes a spring blade (FIG. 9), which, in the installed state, extends along transverse axis 106—which is perpendicular to the plane of motion—along a major portion of the width (i.e., the extension along transverse axis 106) of main element 12. The main direction of deformation of spring element 48 is therefore oriented along tool axis 30. In addition, spring element 48 prevents handle 14 from becoming displaced perpendicularly to the plane of motion. Spring element 48 may therefore result in a high level of mobility of handle 14 in the plane of motion, and, in combination with rotary element 52, an effective guidance of a motion of handle 14 in the plane of motion may be attained. Furthermore, spring blade 104 is profiled such that a load placed on spring element 48 when handle 14 is moved relative to main element 12 is distributed homogeneously across the entire extension of spring blade 104 along transverse axis 106. This makes it possible to utilize material effectively, and undesired tension peaks may be prevented. To further stabilize handle 14 along transverse axis 106, main element 12 includes reinforcement ribs 108 in the range of motion of spring element 48 and lever arm 86, 88 (see FIG. 1). Reinforcement ribs 108 are used as lateral stops and provide additional reinforcement for housing elements 16, 18.

Figure 3:
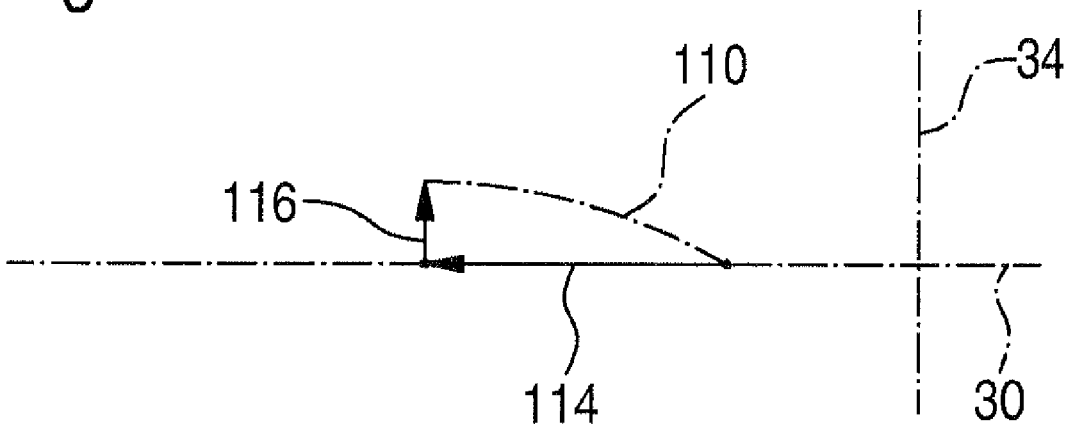
FIG. 3 shows a trajectory of a portion of the handle.
Figure 4:
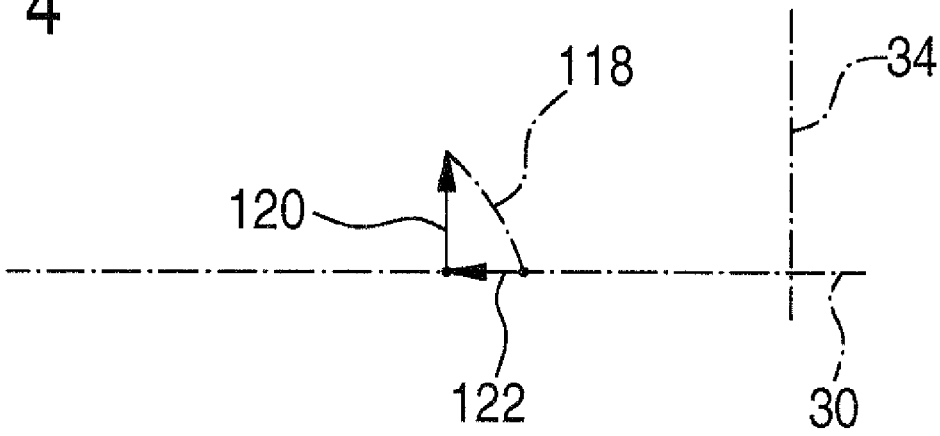
FIG. 4 shows a trajectory of a further portion of the handle.

A trajectory is defined by spring unit 46, along which a portion of handle 14—specifically, upper connection region 64 of handle 14—is guided when main element 12 is approached. In the present exemplary embodiment, spring element 48 rolls along support means 50—which is provided with a special profile—and, specifically, on mating surface 56, when handle 14 approaches main element 12, having been triggered by load force 102. Via this rolling motion of spring element 48, upper connection region 64 is guided along a trajectory, which is depicted schematically in the figure. The trajectory is designed as a circular path, center point 112 of which corresponds to a contact point of mating surface 56, at which spring element 48 and support means 50 separate from each other in the neutral position. When handle 14 undergoes inward spring deflection, upper connection region 64 therefore makes a tilting motion along trajectory 110, which is designed as a circular segment. As shown in FIG. 3, trajectory 110 includes an axial component 114 along tool axis 30, and a normal component 116 along normal axis 34. In this example, normal component 116 of trajectory 110 constitutes 25% of axial component 114. Advantageously, in order to attain an effective damping effect, normal component 116 may be between 15% and 35% of axial component 114. As a result, the motion of upper connection region 64 of handle 14 is advantageously adapted to a main oscillation direction of main element 12, which is essentially oriented along tool axis 30. When handle 14 makes an approaching motion, lower connection region 92 makes a swiveling motion around rotation point 82 of fastening element 22—which is used as a bearing point for supporting rotary element 52 in main element 12—along a trajectory 118, which is designed as a circular segment. As shown in FIG. 4, trajectory 118 includes a normal component 120 and an axial component 122; axial component 122 constitutes 66% of normal component 120.

The total motion of handle 14 in the plane of motion may be depicted as rotation around an instantaneous center. This instantaneous center represents a joint-free rotation axis 124, about which handle 14 rotates. The instantaneous center is located at the intersection point of path normals 126, 128 of trajectories 110 and 118 of upper and lower connection regions 64 and 92, respectively. The position of rotation axis 124 depends on an angle $\alpha$, which is defined by a straight line that extends through rotation points 82, 84 and corresponds to path normal 128, and by tool axis 30. Angle $\alpha$ represents the inclination of rotary element 52 relative to tool axis 30. The position of rotation axis 124 depends on the position and shaping of support means 50, in particular on the position relative to connection region 64 and the radius of the annular subregion. In the present exemplary embodiment, angle $\alpha$ has a value of 25°. Furthermore, in this embodiment, the position of support means 50 in the plane of motion and the radius of the annular subregion of support means 50 were selected such that the instantaneous centers of handle 14 and main element 12 coincide, thereby making it possible to optimally compensate for oscillation motions of main element 12 by handle 14 and to attain a particularly high level of operator comfort. Rotation axis 124 is situated entirely in front of handle 14. Handle 14 is situated behind tool fitting 24, relative to tool axis 30. In one variant of the embodiment, the hinged support of lever arms 86, 88 in lever receptacle 90 may be eliminated. In this case, the instantaneous center of handle 14 coincides with rotation point 82 in fastening element 22.

Figure 5:
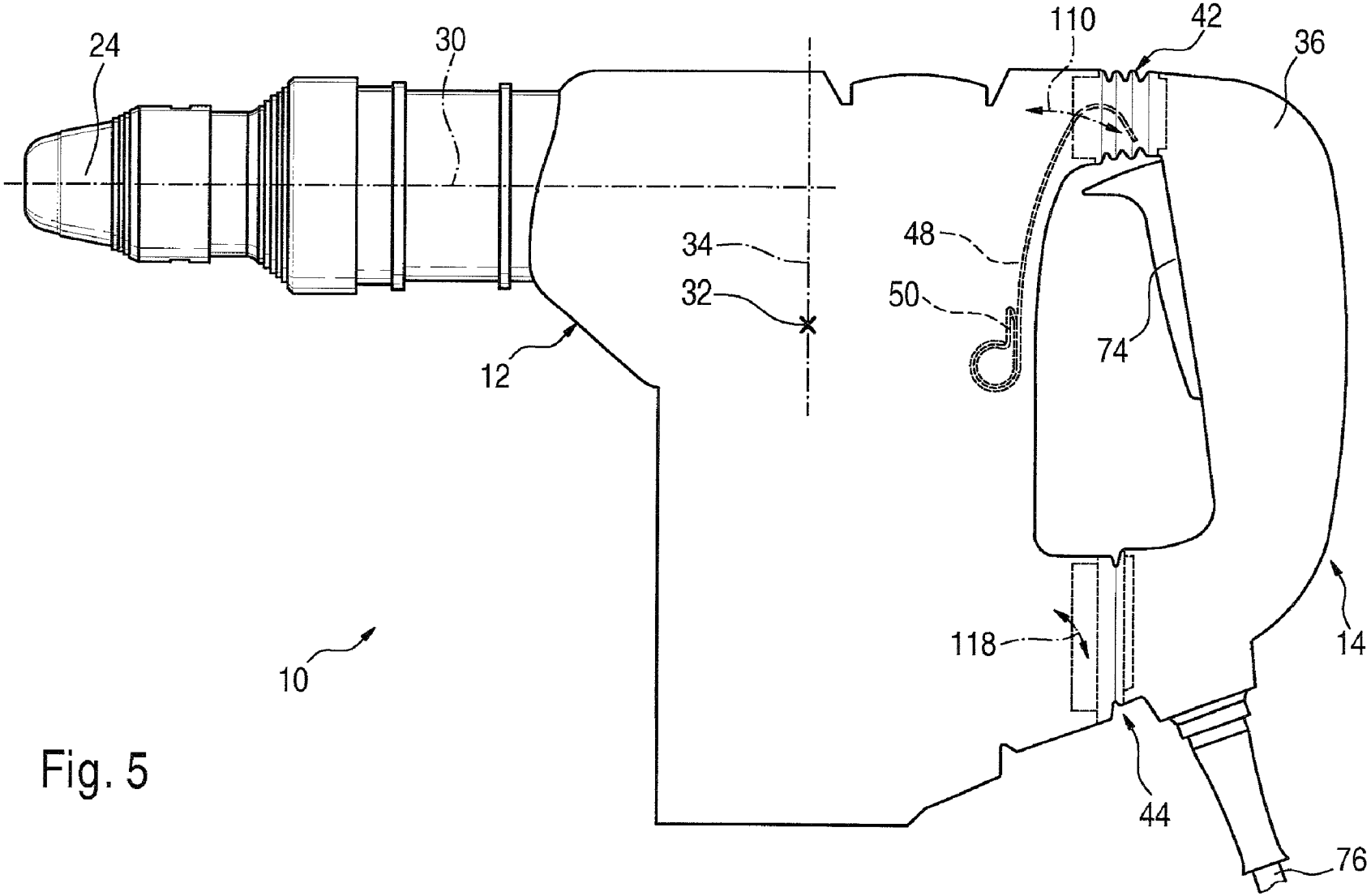
FIG. 5 shows the rotary hammer and/or chisel hammer with the handle, which has approached the main element.

Hand-held power tool 10 is shown in FIG. 5 after handle 14 has approached main element 12. In addition, the rolling motion of spring element 48 on support means 50 is made clear by comparing FIGS. 2 and 5. Main element 12 also includes a stop 125 (see FIG. 1), via which spring element 48 may be arrested when main element 12 is approached. In one variant of the embodiment, it is feasible for stop 125 to be provided with a foamed material in order to dampen the impacts.

Figure 6:
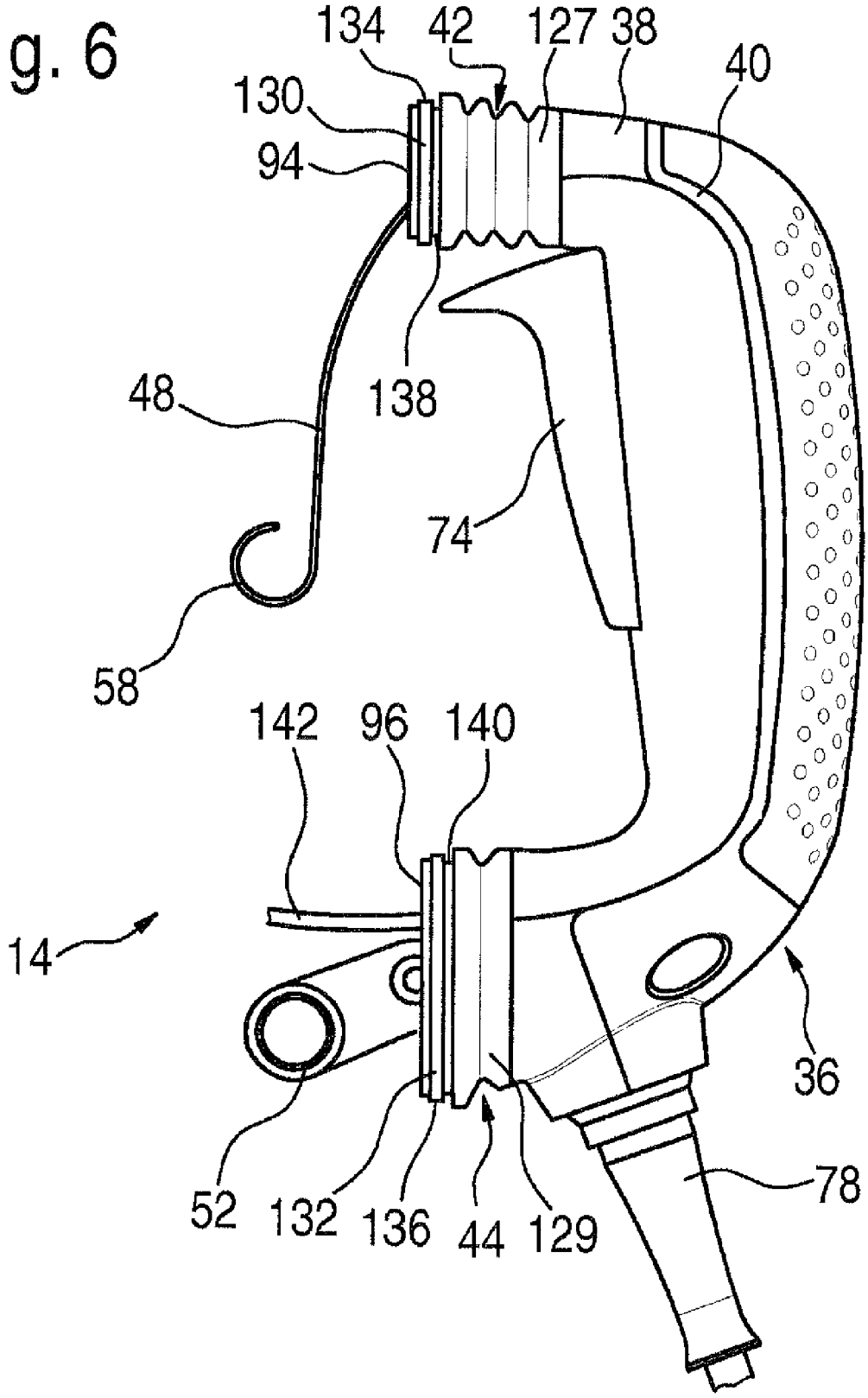
FIG. 6 shows the handle of the rotary hammer and/or chisel hammer, which has been separated from the main element.

In FIG. 6, handle 14 is shown separate from main element 12. Handle body 36 with housing element 38—which is designed as a handle pot—and handle cover 40 are shown. Press button 74 and cable guide 78 are supported in handle body 36. Bellows units 42, 44 are attached to handle body 36. Bellows units 42, 44 each include a body 127, 129, which form a bellows, and a fixing region 130 and 132, which is integrally formed with body 127 and 129. Fixing regions 130 and 132 each include an annular end 134 and 136, which forms a groove 138 and 140 with body 127 and 129. Fixing elements 94, 96 for fixing bellows units 42, 44 on main element 12 are also shown; they extend out of connection regions 64, 92 (FIG. 1). Spring element 48 also extends out of upper connection region 64, while rotary element 52 and an electrical connection cable 142 for connecting switch 72 (FIG. 1) to the electric motor extend out of lower connection region 92 (FIG. 1). Handle 14 shown in FIG. 6 is designed as a pre-installation assembly, which is pre-installed before hand-held power tool 10 is assembled, and which is referred to below as the handle assembly.

Figure 7:
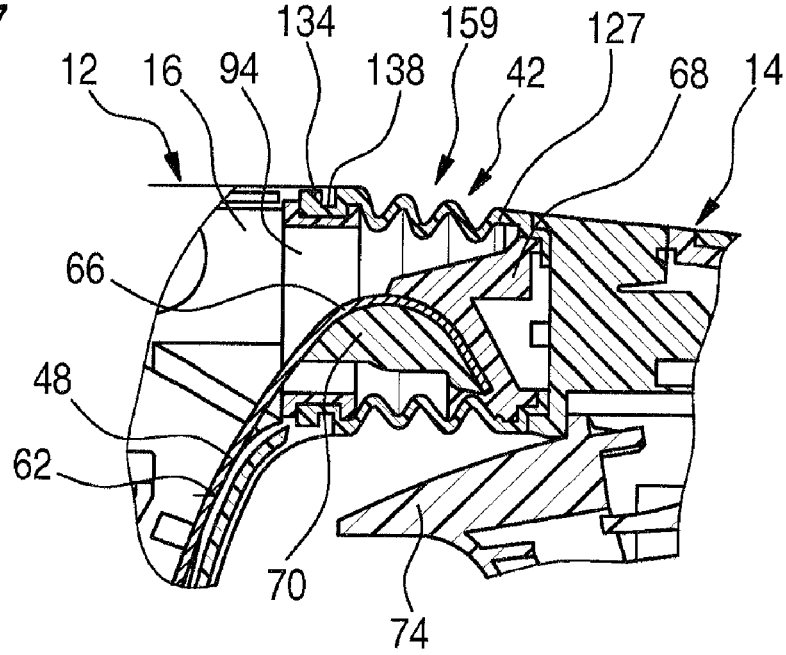
FIG. 7 shows a connection region in FIG. 1, in an enlarged view.
Figure 8:
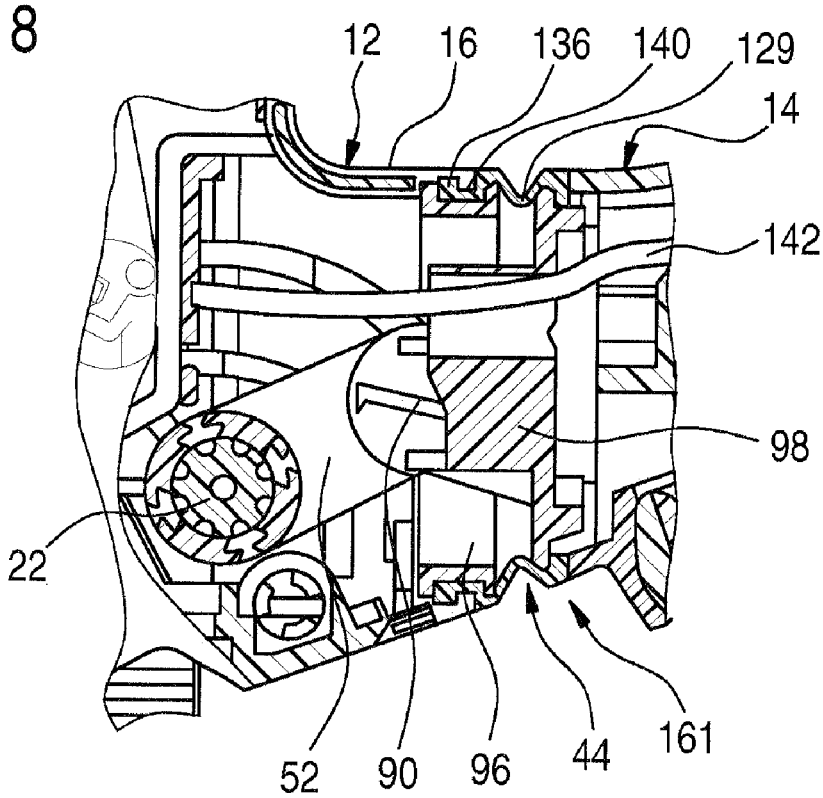
FIG. 8 shows a further connection region in FIG. 1, in an enlarged view.

When hand-held power tool 10 is assembled, this handle assembly is inserted in first housing element 16—which is designed as an assembly shell—of main element 12. This assembly is described with reference to FIG. 1 and to FIGS. 7 and 8, which show connection regions 64, 92 in FIG. 1 in an enlarged view. When the handle assembly is inserted into housing element 16, subregion 58—which is designed as an eyelet—of spring element 48, and lever arms 86, 88 (FIG. 9) are slid onto fastening means 20, 22—which are designed as screw receptacles—of main element 12. At the same time, via end 134 and 136, and groove 138 and 140 of fixing region 130 and 132 of bellows unit 42 and 44 establish a groove-spring connection with housing element 16. To securely fix bellows units 42, 44 on main element 12, handle 14 is provided with fixing elements 94, 96, which are made of plastic, as a support frame. In the installed state, fixing regions 130 and 132 of bellows unit 42 and 44 are clamped between housing element 16 of main element 12 and fixing element 94 and 96. Bellows units 42, 44 are thereby prevented from moving inwardly. After the electrical contacts are established, in particular via connection cable 142, second housing element 18—which is designed as a cover shell—of main element 12 is slid on and is screwed together with first housing element 16.

Figure 9:
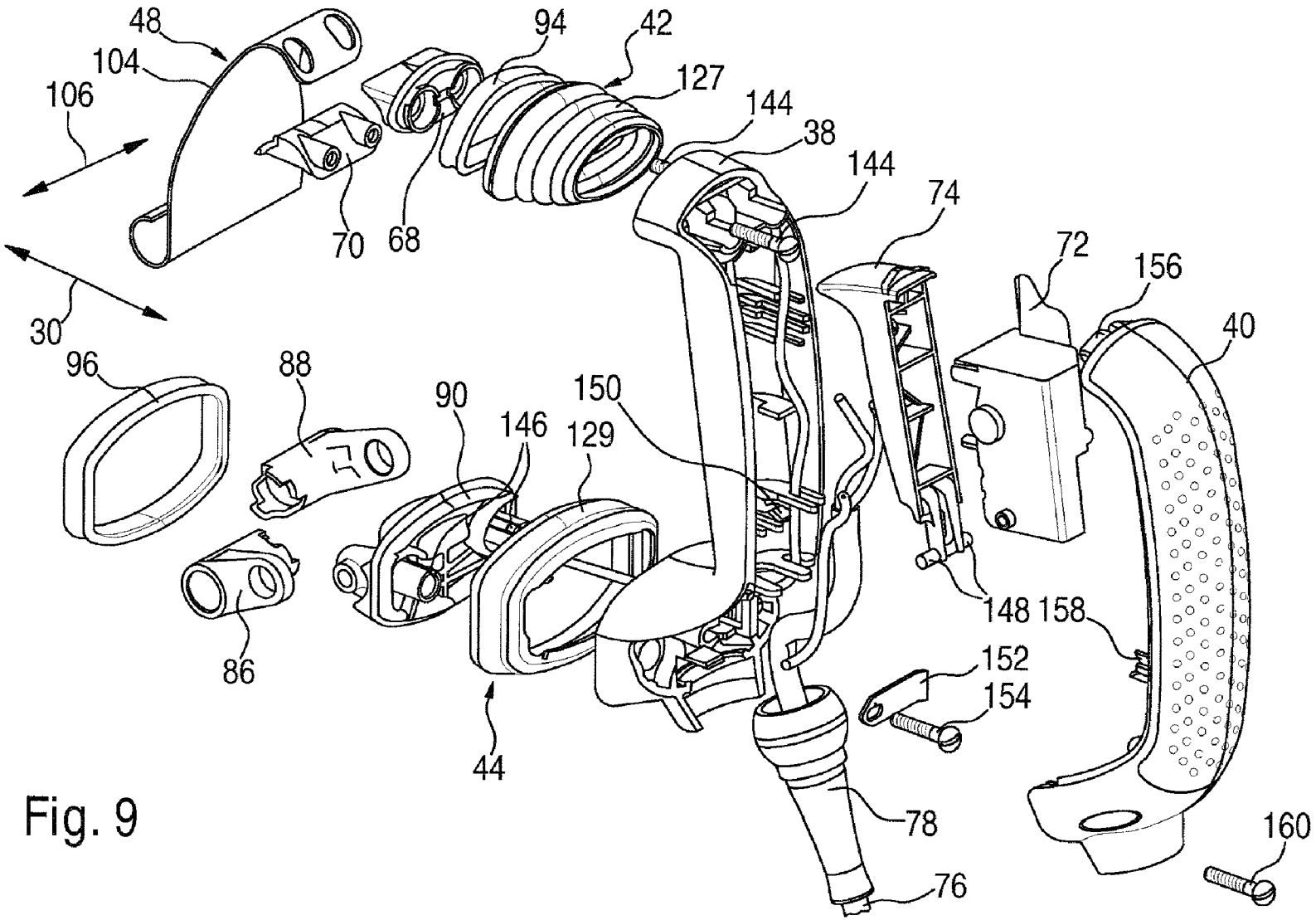
FIG. 9 shows an exploded view of the handle in FIG. 6.

The assembly of handle assembly will be explained with reference to FIG. 9, which is an exploded view of the handle assembly. As shown in the figure, handle body 36 is composed of housing element 38—which is designed as a handle pot—and handle cover 40, which is fixed to handle pot in the installed state. Transverse axis 106, which is oriented in parallel with spring blade 104 of spring element 48 in the installed state, is shown for clarity. In a first assembly step, clamping means 70, which are designed as a vise plate, and fixing element 68 are clipped onto spring element 48. Next, upper bellows unit 42—which is reinforced with fixing element 94 designed as a support frame—is slid onto fixing element 68. The assembly produced in the previous steps is then inserted into housing element 38. This assembly is now screwed onto housing element 38 using two screws 144. Screws 144 are inserted through openings in fixing element 68 and spring element 48 into screw receptacles of clamping means 70. Lever receptacle 90 is then inserted through lower bellows unit 44 and into housing element 38. Two latch hooks 146 of lever receptacle 90 snap into recesses in housing element 38 (not depicted in the figure). Press button 74 is then inserted into housing element 38. A swiveling axis 148—in the form of two bearing bolts—is integrally formed with press button 74, and it snaps in place in a bearing region 150 of housing element 38. Cable connection 76 is then inserted—together with cable guide 78, which is designed as a spherical grommet—into housing element 38, and it is secured against being accidentally pulled out with the aid of a retaining plate 152 by tightening a screw 154. Cable connection 76 is connected to switch 72, which is then inserted into housing element 38. Handle cover 40 includes detent elements 156, which are designed as retaining projections, and which snap into housing element 38 when handle cover 40 is slid on. Handle cover 40 also includes retaining segments 158, which are used to fix switch 72 and press button 74 in place without play when handle cover 40 is slid into place. Handle cover 40 and housing element 38 are then screwed together with lever receptacle 90 using two screws 160. Screws 160 are inserted through openings in housing element 38 into screw receptacles of lever receptacle 90. Lever arms 86, 88 are then placed on lever receptacle 90. Lever arms 86, 88 include two grooves and two pegs on their sides that face each other. When lever arms 86, 88 are connected, a fixed, non-rotatable connection is attained. In the next step, fixing element 96, which is designed as a support frame, is slid past lever arms 86, 88 into lower bellows unit 44. Fixing element 96 prevents lever arms 86, 88 from falling out. When the assembly steps described above are completed, all of the components of the handle assembly described here are captively integrated in the handle assembly.

Figure 10:
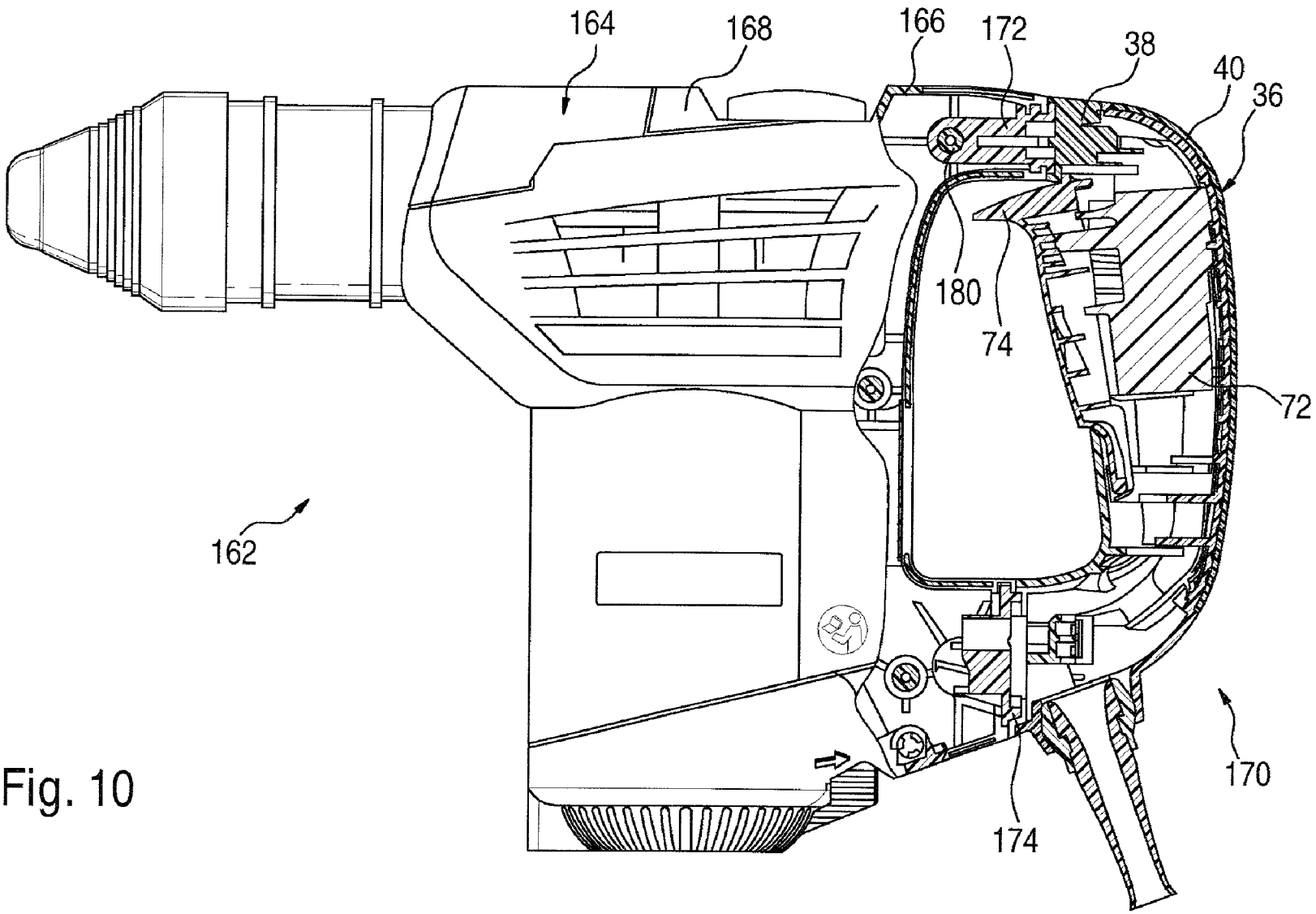
FIG. 10 shows the rotary hammer and/or chisel hammer in FIG. 1, with a rigidly coupled handle.

The handle assembly also has a flexible, modular design. Bellows unit 42—together with fixing elements 68, 94 and bellows unit 44 with fixing elements 96, 98—form two fastening modules 159 and 161, each of which forms a fastening interface for attaching handle body 36 to main element 12 (see FIGS. 7 and 8). In particular, as described above, the attachment to main element 12 via these fastening modules 159, 161 is realized by establishing groove-spring connections, thereby making it possible to attain particularly easy assembly. It is also possible to attain a simple replacement of fastening modules 159, 161. After housing element 18—which is designed as a cover shell—is removed, fastening modules 159, 161, which have been inserted into housing element 16 designed as an assembly shell, may be easily removed from housing element 16 without the use of tools, handle 14 being removed from main element 12. After screws 144, 160 are removed, fastening modules 159, 161 may be removed from handle body 36. Handle body 36 may be used in combination with a further main element of a further hand-held power tool, without the need to redesign handle body 36 any further. This is depicted in FIG. 10. FIG. 10 shows a further hand-held power tool 162—which is designed as a chisel hammer and/or rotary hammer—with a main element 164. Main element 164 includes a first housing element 166 designed as an assembly shell, and a second housing element 168 designed as a cover shell. A handle 170 is attached to main element 164, which is shown separated from main element 164 in FIG. 11. Handle 170 is composed of handle body 36 and two fastening modules 172, 174, which, in the installed state of hand-held power tool 162, are inserted into housing element 166 of main element 164.

Figure 11:
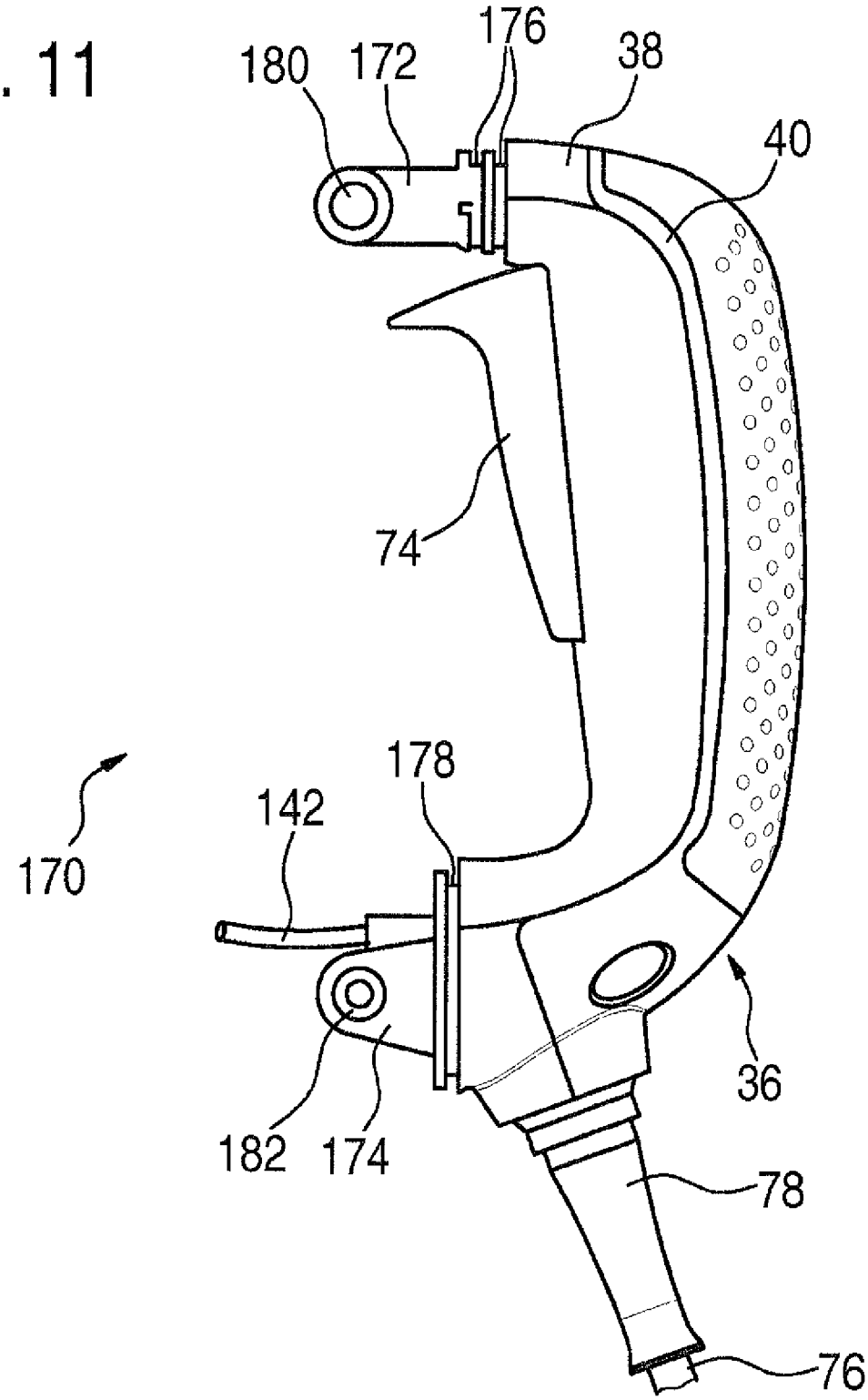
FIG. 11 shows the handle of the rotary hammer and/or chisel hammer in FIG. 10.

Before hand-held power tool 162 is assembled, fastening modules 172, 174 are screwed together—as described above for fastening modules 159, 161—using screws 144 and 160 with housing element 38 designed as a handle pot. The handle assembly, which is now complete and is shown in FIG. 11, is then inserted into housing element 166. When fastening modules 172, 174 are inserted, a groove-spring connection is established between fastening modules 172, 174 and housing element 166. For this purpose, fastening module 172 and 174 includes grooves 176 and 178, into which housing element 166 engages when it is inserted. After the electrical contacts are established, in particular using connection cable 142, housing elements 166, 168 are screwed together. In this process, screws are guided through openings 180, 182 of fastening modules 172, 174.

What is claimed is:

1. A hand-held power tool which includes a main element (12)—which has a tool axis (30), a center of gravity (32), and a normal axis (34), which extends perpendicularly to the tool axis (30) and through the center of gravity (32), the tool axis (30) and the normal axis (34) defining a plane of motion—and a handle (14), which is supported in the plane of motion such that it is movable relative to the main element (12), and including a spring unit (46), which connects the handle (14) with the main element (12), wherein the spring unit (46) comprises a spring element (48) and is provided to at least substantially define a trajectory (110) of at least one portion of the handle (14) in the plane of motion under the influence of a load force (102), which is triggered when the handle (14) is moved out of a neutral position and approaches the stationary main element (12), a handle body (36) of the handle (14), and a rotary element (52), which connects the handle body (36) and the main element (12); in interaction with the spring unit (46), wherein the rotary element (52) defines a joint-free rotation axis (124), about which the handle (14) rotates in the plane of motion when a motion takes place relative to the main element (12), and wherein the spring element (48) is designed as a leaf spring.

2. The hand-held power tool as recited in claim 1, wherein the spring unit (46) includes support means (50) for supporting the spring element (48), which—in interaction with the spring element (48)—define the trajectory (110).

3. The handle as recited in claim 1, wherein the handle (14) is held in the neutral position by the spring element (48).

4. The hand-held power tool as recited in claim 1, wherein the spring unit (46) includes support means (50) for supporting the spring element (48), and the spring element (48) rolls across the support means (50) when the handle (14) moves relative to the main element (12).

5. The hand-held power tool as recited in claim 1, characterized by a first and a second housing element (16, 18), a fastening element (20) for fastening the first housing element (16) to the second housing element (18), and support means (50) for supporting the spring element (48), which is fixed in position on the fastening element (20).

6. The hand-held power tool as recited in claim 5, wherein the spring element (48) includes a subregion (58), which at least substantially encloses the fastening element (20).

7. The hand-held power too as recited in claim 1, characterized by a clamping means (70) for clamping the spring element (48).

8. The hand-held power tool as recited in claim 1, characterized by a handle body (36) of the handle (14), a housing element (38), a bellows unit (42), which connects the main element (12) with the handle body (36), and a fixing element (68), which is provided to fix, at the least, the bellows unit (42) and the spring element (48) on the housing element (38).

* * * * *